United States Patent [19]

Mohon et al.

[11] 4,223,454

[45] Sep. 23, 1980

[54] MARKSMANSHIP TRAINING SYSTEM

[75] Inventors: Windell N. Mohon, Winter Park; Frank J. Oharek, Orlando; Robert J. Entwistle, Winter Park; David T. Long, Oviedo; John C. McKechnie, Maitland; Don D. Doty, Winter Park, all of Fla.

[73] Assignee: The United States of America as represented by the Secretary of the Navy, Washington, D.C.

[21] Appl. No.: 943,601

[22] Filed: Sep. 18, 1978

[51] Int. Cl.[3] ..... F41J 5/02

[52] U.S. Cl. ..... 35/25

[58] Field of Search ..... 35/25; 273/101.1, 101.2, 273/102.1 R, 102.2 R, 105.1; 46/256, 244 R

[56] References Cited

U.S. PATENT DOCUMENTS

| | | | |
|---|---|---|---|
| 3,549,147 | 12/1970 | Katter | 273/101.1 |
| 3,675,925 | 7/1972 | Ryan et al. | 273/101.2 |
| 3,748,751 | 7/1973 | Breglia et al. | 273/101.1 |
| 3,811,204 | 5/1974 | Marshall et al. | 35/25 |
| 3,849,910 | 11/1974 | Greenly | 35/25 |
| 3,888,022 | 6/1975 | Pardes et al. | 35/25 |
| 3,911,598 | 10/1975 | Mohon | 35/25 |
| 3,911,599 | 10/1975 | Talley | 35/25 |
| 3,996,674 | 12/1976 | Pardes et al. | 35/25 |
| 4,083,560 | 4/1978 | Kikuchi et al. | 35/25 |
| 4,137,651 | 2/1979 | Pardes et al. | 35/25 |

*Primary Examiner*—Vance Y. Hum

*Attorney, Agent, or Firm*—Richard S. Sciascia; Robert W. Adams

[57] ABSTRACT

A marksmanship training system is disclosed as comprising a viewing screen upon which a scenic picture having a predetermined target included therein is projected by a combination motion picture projector and film. A plurality of simulated rifles shoot laser light shots of different colors, respectively, at the target located within the image of said projected motion picture scene. A like plurality of receiver channels respond to the colors of said laser shots respectively, and as a result of being properly synchronized with said projector and film, determine and indicate the number of target "hits" for any given number of shots. A color television camera and video tape recorder monitor training exercises, and a video tape player permits the playback thereof for additional training purposes. Optionally, a suitable sound system may be used in conjunction with the aforesaid projector and film combination, so as to provide a more realistic training environment for the marksmen while they are shooting at the aforementioned viewing screen with said simulated rifles.

26 Claims, 3 Drawing Figures

MARKSMANSHIP TRAINING SYSTEM

FIELD OF THE INVENTION

The present invention, in general, relates to training simulators and, in particular, pertains to a marksmanship training system for teaching riflemen to shoot laser rifles that simulate real rifles of a predetermined king at targets moving within an ambient environment which simulates some particular substantially real environment.

DESCRIPTION OF THE PRIOR ART

Heretofore, numerous systems have been employed which enable people who desire to improve their shooting skill to do so without practicing in real life situations. Some of such people may, for example, be sportsmen who practice at various and sundry shooting ranges which are owned and operated by local police departments or private clubs; they may perhaps be people seeking the pleasure and entertainment provided by commerical shooting galleries; and they may be military people who are being trained to shoot weapons for purposes of national defense, with the firing thereof thereby taking place at shooting ranges or, as is sometimes the case, in the field, the latter of which may or may not simulate actual combat conditions. In any event, it may readily be seen that there presently exists and has existed in the past many rather simple devices and situations which do or could be used to train marksmen.

In addition to the aforementioned rather well known and conventional target practice situations, the subject prior art also includes a goodly number of more sophisticated methods and means for training people to accurately fire firearm and other type weapons, such as, for instance, guns of the rifle or pistol types. Several of such methods and means are disclosed in patents, several of which, ostensively being representative of the closest known prior art, are discussed as follows: 1. U.S. Pat. No. 3,911,598, issued to Windell N. Mohon (one of the inventors in this case) for Laser Type Weapon Fire Simulation System, discloses a laser type weapon simulator having a holographic means for producing a three dimensional virtual target image combined with a detector-screen means located in a substantially contiguous disposition therewith, so as to effectively provide a combination three-dimensional holographic target and scoring indicator for, in turn, providing "hit" and "miss" indications when a laser rifle is fired thereat. The patent further teaches the use of motion picture projector means to provide relative movement between the aforesaid target image and the background scene therefor.

2. U.S. Pat. No. 3,811,204, issued to Albert H. Marshall and George A. Siragusa for Programmable Laser Marksmanship Trainer, discloses a system employing a screen for viewing a program of scenes provided by photographic slides projected thereon, each scene of which includes a target oriented in front of a plurality of light detectors supported in matrix configuration behind said screen. Said light detectors sense and are, thus, enabled by the laser light fired by a laser rifle (or other laser weapon). Upon being properly enabled, they appropriately actuate an associated hit indicator and cumulative hit counter, so as to provide an indication of hits and misses and a counting of the hits for scoring purposes. A slide projector and a sequential light detector switching means are simultaneously actuated from a common programmer to vary the projected images and target areas located therein by sequentially projecting the aforesaid slides and sequentially varying the aforementioned light detectors.

The devices of the above mentioned patents work quite well for their intended purposes; however, they appear to be limited with respect to the number of trainee marksmen that may use them at the same time. As a matter of fact, if more than one trainee shoots at the targets thereof at any given time and should the shots thereof be fired simultaneously or almost simultaneously, no indication of which one hit the target occurs, if indeed there was a hit. Consequently, somewhat less training would be provided if two or more people were target practicing at the same time with the aforesaid systems.

Moreover, U.S. Pat. No. 3,911,598 ostensively neither provides hit scoring nor recording, although U.S. Pat. No. 3,811,204 does appear to provide hit indications and counting. Accordingly, the subject invention furthers the state of the art because of the new, unique, unobvious synergistic effects produced by the new, useful, and unobvious combination of elements constituting it; therefore, it is deemed to patentably distinguish thereover under 35 USC 103.

SUMMARY OF THE INVENTION

The subject invention constitutes a rifle squad fire simulation system which comprises a plurality of laser rifles which are fired by trainee marksmen at a viewing screen upon which is displayed a motion picture containing a given panoramic view with a moving target included therein. Also displayed on said screen are spots of light that are intended to indicate, in simulated fashion, the firing of other guns, thereby giving said trainee marksmen a feeling that they are participating in a full squad effort.

The fire of the trainees is scored individually for target hits by a closed circuit color television system and data comparison and readout techniques, the data of which is provided by the intermittent moving pictures of the target and laser rifle pulses, the relative positions of which occur on the aforesaid viewing screen and, thus, indicate hits or misses, as the case may be. A video recording and playback of the entire combat scene enables a subsequent training critique session to be held, thereby facilitating the instructing of marksmen trainees in the ways of more accurate shooting. Of course, an ancillary benefit of the subject system is that, to some extent, it psychologically conditions the marksmen trainees to remain sufficiently calm and fearless in a real combat or hunting situation to function efficiently therein. Of course, observer trainee marksmen may also benefit from the subject invention, in that they may watch others perform in the simulated combat situation (or later during the critique), note errors made by the participating marksmen trainees, and thus learn in advance how to prevent their making such errors themselves.

In view of the above, it may readily be inferred that an object of this invention that is of paramount importance is to provide an improved marksmenship training system.

Another object of this invention is to provide an improved and means for training people to function in an optimum manner in a precarious environment by means of realistically simulating the operational conditions of that environment.

Still another object of this invention is to provide an improved rifle squad weapon fire simulation system.

A further object of this invention is to provide an improved target system that permits the counting of laser rifle hits and misses by laser rifle marksmen, even though a plurality thereof are shooting at the same target at substantially the same time.

Still another object of this invention is to provide an improved signal separator for training and other devices, which effectively prevents the simultaneous actuation thereof by human or other operators.

Another object of this invention is to provide an improved simulator that permits and facilitates the training of a plurality of squads of riflemen at the same time in an integrated parapet foxhole concept of defense.

Another object of this invention is to provide an improved target system that is responsive to laser light bursts or shots having a plurality of different colors, respectively, and, furthermore, which provides indications thereof with respect to predetermined target indicia, regardless of the weapons or other devices from which they are received.

Another object of this invention is to provide an improved marksmen training target system which facilitates doing a shooting critique during a shooting situation or at some subsequent time for the shooters and/or others, as desired.

Other objects, advantages and novel features of the invention will become apparent from the following detailed description of the invention when considered in conjunction with the accompanying drawing wherein:

DESCRIPTION OF THE PREFERRED EMBODIMENT

Figure 1:
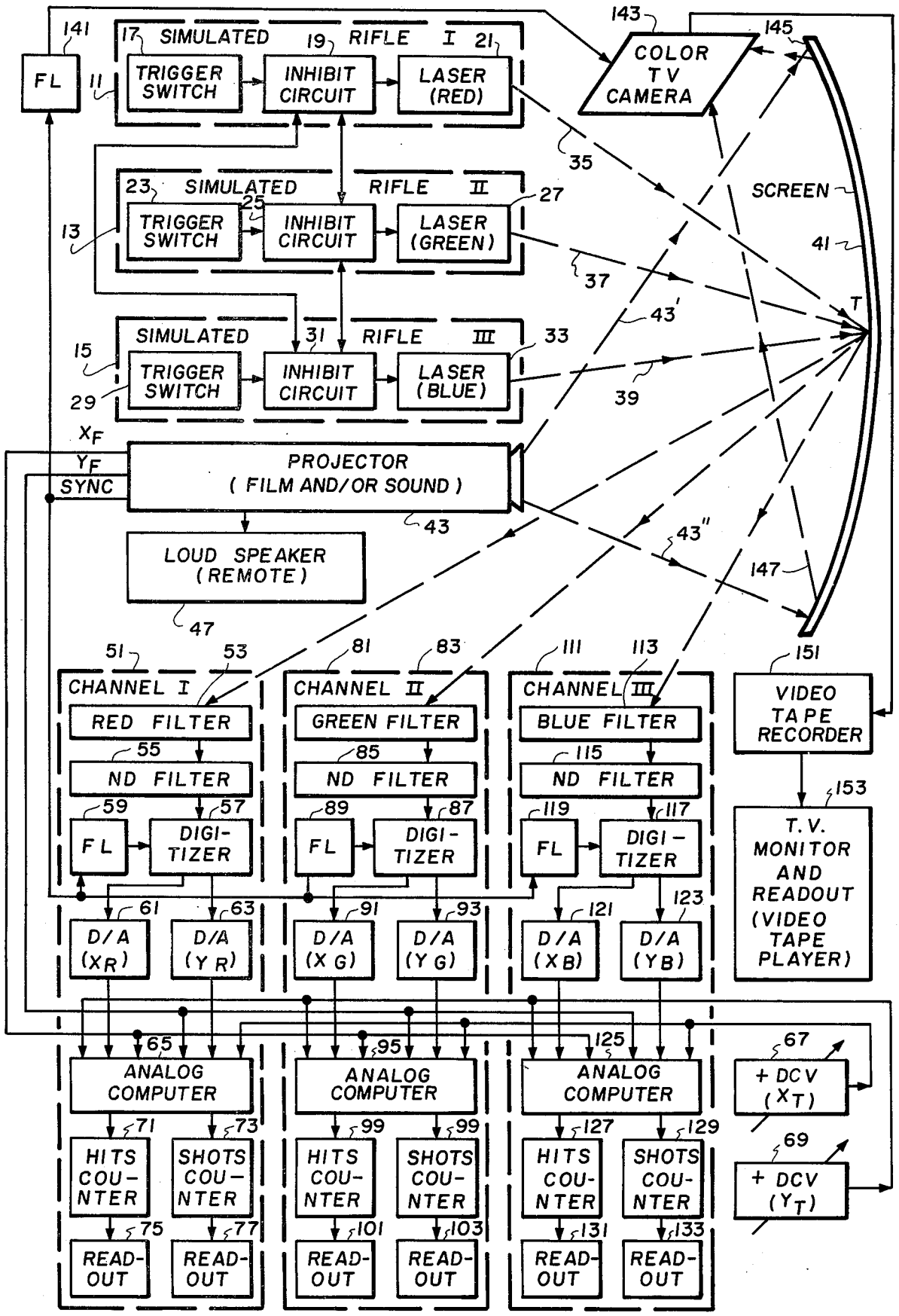
FIG. 1 discloses a combined block and schematic diagram of the marksmanship training system constituting the subject invention.

Referring now to FIG. 1, the marksmanship training system constituting the invention is shown as having a trio of laser rifles 11, 13, and 15, each of which simulates some predetermined real rifle, but shoots laser light pulses instead of bullets. As a matter of fact, rifles 11, 13, and 15 may actually be real rifles with adjunct laser light projectors attached thereto or they may be simulated rifles which have been designed to include lasers therein. Of course, they may be other weapons, too; or they could be any other type of device or instrument requiring the accurate sighting thereof for any given operational purposes. Nevertheless, in order to keep this disclosure as simple as possible, but without any limitation intended, rifles 11, 13, and 15 will be considered herein as being the simulated laser rifles I, II, and III of FIG. 1.

Obviously, it would be well within the purview of one skilled in the art having the benefit of the teachings presented herein to substitute any preferred gun, weapon, or other device which requires sighting and training in order to be properly used, for any or all of the aforesaid simulated laser rifles, inasmuch as so doing would merely involve the making of design choices. Furthermore, it would be obvious that the subject invention could readily be designed to include any desired number of rifles, thereby facilitating the training of one or more large and/or small rifle squads.

Whether or not simulated rifles 11, 13, and 15 are identical otherwise, they must each include several components which are pertinent to this invention. Accordingly, in simulated rifle 11, such components are shown as being a trigger switch 17, the output of which is connected to the input of an inhibit circuit 19, the output of which is, in turn, connected to the input of a narrow band red laser 21; in simulated rifle 13, such components are a trigger switch 23, the output of which is connected to the input of an inhibit circuit 25, the output of which is, in turn, connected to the input of a narrow band green laser 27; and in simulated rifle 15, such components are a trigger switch 29, the output of which is connected to the input of an inhibit circuit 31, the output of which is, in turn, connected to the input of a narrow band blue laser 33.

At this time, it would perhaps be noteworthy that inhibit circuits 19, 25, and 31 are circuits which prevent the simultaneous firing of two or more of the aforesaid lasers 21, 27, and 33, even if two or more of the aforesaid trigger switches are closed at the same time due to the respective triggers connected thereto having been pulled at the same time by trainee marksmen. The particular circuitry involved in said inhibit circuits will be discussed more fully in conjunction with FIG. 2 subsequently; nevertheless, as portrayed in block diagram form in FIG. 1, the inputs-outputs of each thereof are connected to the respective inputs-outputs of each of the others in such manner as to cause the enabling of any one of the inhibit circuits to effect the momentary disabling of all of the other inhibit circuits, so as to actually prevent the firing of lasers 21, 27, and 33—and, hence, rifles 11, 13, and 15—at the same time, while permitting the firing of any one thereof very shortly thereafter. Although, as a general rule, the simultaneous pulling of the triggers of two or more of rifles 11, 13, and 15 is rare, it occurs often enough to make the incorporation of the aforesaid inhibit circuits therein optimize the operation of the invention for most practical purposes.

In addition, it should perhaps be understood at this time that the respective colors of lasers 21, 27, and 33 may be any that would optimize the operation of the subject invention for any given purpose and for use with any given target image or background scenery used therefor, as will also be explained more fully later during the discussion of the operation of the invention.

Accordingly, suffice to say now, that the number of simulated rifles employed during any particular training exercise and the colors of the lasers incorporated therein are matters of design choice. Thus, it would obviously be well within the purview of one skilled in the art having the benefit of the teachings presented herewith to select such number of simulated rifles and the laser colors therefor as would make them compatible with the training experience desired to be given to whatever number of trainee marksmen is involved.

As previously suggested, the output of laser 21 is a red laser beam shot 35, the output of laser 27 is a green laser beam shot 37, and the output of laser 31 is a blue laser beam shot 39, all of which, when fired, are shot on some predetermined target T projected on a viewing screen 41 by a projector 43 of film and/or sound. In addition to projecting targets on screen 41, projector 43 is preferably a motion picture projector that projects scenes thereon which simulate actual conditions that a marksman would or could encounter if he were, say, for instance, in an actual combat or hunting situation, thereby making his training experience be or feel more realistic. Of course, sounds simulating such combat or other situation could be played in a fashion that coordinates them therewith, in order to increase and improve the total learning experience of the marksmen trainees. Hence, projector 43 may be designed for such operation—that is for the projection of film and/or sound—if so desired, since so doing would not violate the spirit and scope of this invention. In any event, if so desired, any of the SC-10 series movie projectors obtainable from Rangertone Research, Inc., of Newark, New Jersey, or New York, New York, may be used for such purpose.

Projector 43 projects film images—the boundaries of which are represented by dashed lines referenced by numerals 43' and 43'', respectively—on screen 41, which, as previously mentioned, includes predetermined background scenes with target T superimposed thereon or included therein. Projector 43 has four output signals, herewith defined as $X_F$, $Y_F$, sync, and an audio output signal. $X_F$ means the distance target T is located from a certain real or imaginary ordinate, $Y_F$ means the distance T is located from a certain real or imaginary abscissa, with said $X_F$ and $Y_F$ coordinate distances (and signals corresponding thereto) being programmed on the film being projected by projector 43 in combination with a predetermined synchronization signal. Said audio output signal is, in fact, an electrical signal that carries the audio intelligence to any suitable electroacoustical transducer or transducers, such as, for example, a remote loud speaker or speakers 47, that may be placed in proximity with screen 41 or the marksmen firing rifles 11, 13, and 15, or any place else. Obviously, said electroacoustical transducers may be earphones worn by the aforesaid marksmen trainees, by instructors, or other observers, if so desired. Hence, without limitation, the environment of all concerned may be made such as would simulate any real or other environmental situation.

For most practical purposes, that which has been described so far may be considered as being a unique subsystem for generating, projecting, and displaying certain optical and audio signals, with the purposes thereof being contingent upon selections made by the artisan and the use to be made thereof by said artisan and/or others. Accordingly, another subsystem, herewith defined as being a unique receiver type subsystem, will be described which is employed in a new and unusual operational combination with the aforesaid signals generating, projecting, and displaying subsystem, so as to effect a vastly improved rifle squad training system.

Because only three simulated or laser rifles have been depicted in FIG. 1, only three receiver channels have likewise been shown therein. Nevertheless, as previously suggested, any number thereof may be constructed without violating the spirit and/ or scope of the invention, just so long as the number of receiver channels equals the number of simulated rifles and are optically compatible therewith, as will now be discussed.

Again referring to FIG. 1, a first channel 51, herewith further defined as being a red channel, is shown as comprising a narrow red bandpass optical filter 53 which receives and passes only that frequency of red light that has been shot from the aforesaid red laser 21 of simulated rifle 11. Spatially disposed downstream therefrom along a first predetermined optical path is a conventional neutral density (ND) filter 55, such as, for instance, Wratten filter No. 96, manufactured by the Eastman Kodak Company of Rochester, New York. The latter acts as a thresholder that passes only the light within a narrow frequency band which is above a preset intensity, i.e., only that amount of red light (in this instance) that will be bright enough to be "seen" or optically responded to by an optical data digitizer.

Spatially disposed downstream from said ND filter 55 and along said first optical path is an optical data digitizer 57, which, as indicated above, will respond to the certain preset level or amount of red light passed therethrough. A model No. 658A optical data digitizer, manufactured by EMR Photoelectric Division of the Schlumberger Company of Princeton, New Jersey, may be used as said data digitizer 57 (and all of the data digitizers of this system, for that matter) because it operates on a predetermined optical input signal and produces at a pair of outputs thereof the binary equivalent of a two-dimensional optical image that, in turn, represents the "X" and "Y" coordinates thereof with respect to predetermined reference datums, respectively. In this particular case, said "X" and "Y" coordinates would define the position of any red spot of laser light 35 beamed to and reflected from screen 41 with respect to any predetermined imaginary or real abscissa and ordinate thereon or associated therewith.

Data digitizer 57 has a frame lock input which is connected to the output of a frame lock circuit 59, the input of which is connected to the sync output of the aforesaid projector 43. The aforementioned frame lock circuit 59 may, of course, be any suitable conventional one; however, it has been determined that frame lock (or synchronization device) Model MTV-101, obtainable from Rangertone Research, Inc., of New York, New York, may be used therefor.

The "X" and "Y" coordinate outputs of data digitizer 57 are connected to the inputs of a pair of digital-to-analog circuits 61 and 63, respectively; and the outputs thereof are connected to a pair of the inputs of an analog computer 65, the latter of which will be disclosed in and discussed in some detail in conjunction with FIG. 3 subsequently. Another pair of the inputs of analog computer 65 is respectively connected to the $X_F$ and $Y_F$ outputs of the aforesaid projector 43, and the remaining pair of inputs thereof is respectively connected to the $X_T$ and $Y_T$ outputs of a pair of adjustable positive direct current voltage sources or generators 67 and 69.

Analog computer 65 has two outputs, one of which is connected to the input of a "hits" counter 71, and the other of which is connected to the input of a "shots" counter 73; and the outputs of said counters 71 and 73 are connected to the inputs of a pair of readouts 75 and 77, the former of which reads out the number of times target T has been hit by red laser shots 35, and the latter of which reads out the number of red laser shots fired by simulated rifle 11.

A second channel 81, herewith defined as being a green channel, is shown as comprising a narrow green bandpass optical filter 83 which receives a passes only that frequency of green light that has been shot as a beam 37 from the aforesaid green laser 27 of simulated rifle 13. Spatially disposed downstream therefrom along a second predetermined optical path is a conventional neutral density (ND) filter 85 similar to that of the Wratten filter No. 96 manufactured by the Eastman Kodak Company of Rochester, New York. Like the aforesaid ND filter 55 of Channel I, the latter acts as a thresholder that passes only the light in a narrow frequency band of green which is above a preset intensity, that is, only that amount of green light (in this instance) that will be bright enough to be "seen" or optically responded to by an optical data digitizer.

Spatially disposed from said ND filter 85 and along said second optical path is an optical data digitizer 87 which, as indicated above, will respond to the said preset level of amount of green light passed through ND filter 85. A Model No. 658A optical data digitizer, manufactured by EMR Photoelectrical Division of Schlumberger Company of Princeton, New Jersey, may be used as said data digitizer 87 in a manner similar to the way it may be used as the aforesaid data digitizer 57 because it operates on a similar predetermined optical signal and produces at the outputs thereof the binary equivalents of a two-dimensional optical image that, in turn, likewise represent the "X" and "Y" coordinates thereof with respect to predetermined reference datums, respectively. In this particular instance, said "X" and "Y" coordinates would define the position of any green spot of laser light 37 of the predetermined frequency selected and beamed to and reflected from viewing screen 41 with respect to any predetermined imaginary or real abscissa and ordinate thereon or associated therewith. Data digitizer 87 has a frame lock input which is connected to the output of a frame lock circuit 89, the input of which is connected to the sync output of the aforesaid projector 43. Like the aforesaid frame lock 59 of Channel I, frame lock circuit 89 may be Model MTV-101, obtainable from Rangertone Research, Inc., of New York, New York, or any other conventional one.

The "X" and "Y" coordinate outputs of data digitizer 87 are connected to the inputs of a pair of digital-to-analog circuits 91 and 93, respectively; and the outputs thereof are connected to a pair of the inputs of an analog computer 95, the latter of which, like analog computer 65, will be disclosed and discussed in some detail in conjunction with FIG. 3 subsequently. Another pair of the inputs of analog computer 95 is respectively connected to the $X_F$ and $Y_F$ outputs of the aforesaid projector 43, and the remaining pair of inputs thereof is respectively connected to the $X_T$ and $Y_T$ outputs of the aforesaid pair of adjustable negative direct current voltage generators 67 and 69.

Analog computer 95 has two outputs, one of which is connected to the input of a "hits" counter 97, and the other of which is connected to the input of a "shots" counter 99. The outputs of said counters 97 and 99 are connected to the inputs of a pair of readouts 101 and 103, the former of which reads out the number of times target T has been hit by green laser shots 37, and the latter of which reads out the number of green laser shots fired by simulated rifle 13.

A third Channel 111, herewith defined as being a blue channel, is shown as comprising a narrow blue bandpass optical filter 113 which receives and passes only that frequency of blue light that has been shot as a beam 39 from the aforesaid blue laser 33 of simulated rifle 15. Spatially disposed downstream therefrom along a third predetermined optical path is a conventional neutral density (ND) filter 115 which is substantially identical to the aforementioned ND filters 85 and 55. Again, the latter acts as a thresholder that passes only the light within a narrow frequency band which is above some preset intensity, that is, only that amount of blue light (in this instance) that will be bright enough to be "seen" or be optically responded to by an optical data digitizer.

Spatially disposed downstream from said ND filter 115 and along said third optical path is an optical data digitizer 117 which will be such as will respond to the aforesaid blue light that is passed through said ND filter 115. Again, data digitizer 117 will be similar to the aforesaid data digitizers 87 and 57. It, too, operates on a predetermined optical input signal and produces at a pair of outputs thereof the binary equivalent of a two-dimensional optical image that, in turn, represents the "X" and "Y" coordinates thereof with respect to predetermined reference datums, respectively. In this particular case, said "X" and "Y" coordinates would define the position of any blue spot of laser light 39 beamed to and reflected from viewing screen 41 with respect to any predetermined imaginary or real abscissa and ordinate thereon or associated therewith but which, most likely, will coincide with the abscissas and ordinates used in conjunction with the aforesaid red and green channels 51 and 81. Data digitizer 117 has a frame lock input which is connected to the output of a frame lock circuit 119, the input of which is connected to the sync output of the aforesaid projector 43. Again, any suitable frame lock circuit may be used as frame lock circuit 119; however, if so desired, the aforesaid Model MTV-101 of Rangertone Research, Inc., may also be used therefor. The "X" and "Y" coordinate outputs of data digitizer 117 are connected to the inputs of a pair of digital-to-analog converter circuits 121 and 123, respectively; and the outputs thereof are connected to a pair of the inputs of an analog computer 125 which is substantially identical to the aforementioned analog computers 95 and 65 and, thus, will be discussed more fully below in conjunction with FIG. 3. Another pair of the inputs of analog computer 125 is respectively connected to the $X_F$ and $Y_F$ outputs of projector 43, and the remaining pair of inputs thereof is respectively connected to the $X_T$ and $Y_T$ outputs of the aforesaid pair of adjustable negative direct current voltage generators 67 and 69.

Analog computer 65 has two outputs, one of which is connected to the input of a "hits" counter 127 and the other of which is connected to the input of a "shots" counter 129; and the outputs of said counters 127 and 129 are connected to the inputs of a pair of readouts 131 and 133. Of course, like the aforementioned readouts 101 and 75, readout 131 reads out the number of times target T has been hit by blue laser shots 39, and similar to readouts 103 and 77, readout 133 reads out the number of blue laser shots fired by simulated rifle 15.

Another frame lock circuit 141 (similar to frame locks 59, 89, and 119) is connected to the sync output of the aforesaid projector 43, and the output thereof is connected to the sync input of a color TV camera 143, the latter of which is directed for receiving images from screen 41 within the area loosely defined by dashed lines 145 and 147. The output of color TV camera 143 is connected to the data input of a video tape recorder 151, the output of which is, in turn, connected to the input of a TV monitor and readout 153 which may, for example, be a video tape player.

Figure 2:
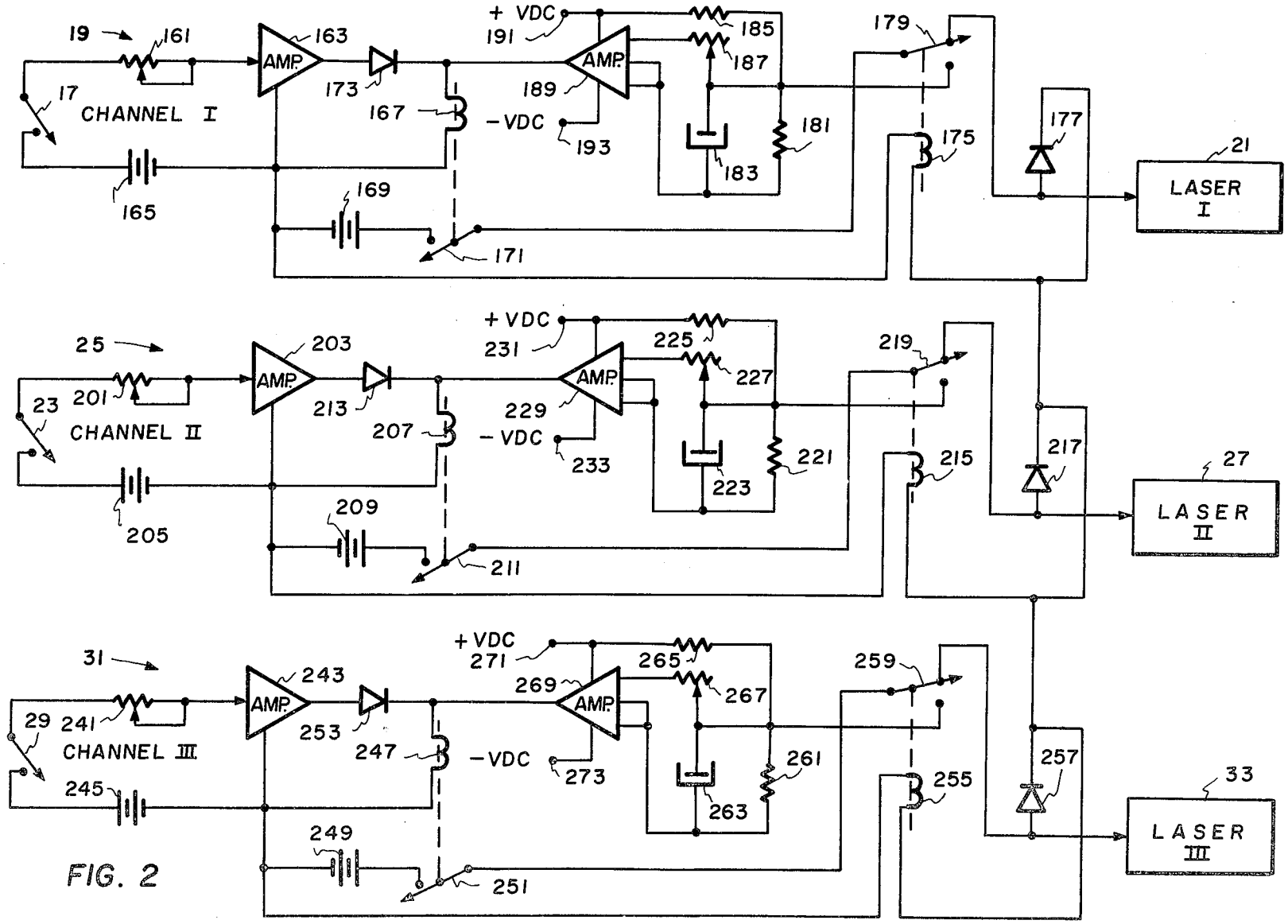
FIG. 2 schematically depicts the inhibit circuits that are incorporated in the embodiment of the invention disclosed in FIG. 1.

Referring now to FIG. 2, there is shown a plurality of inhibit circuits that are representative of inhibit circuits 19, 25, and 31 and which are interconnected in such manner as to be operative in combination with the remainder of the circuitry of simulated rifles 11, 13, and 15, respectively. Of course, whatever number of simulated rifles are incorporated in the subject invention will determine the number of inhibit circuits employed. Thus, it would be obvious to the artisan that three, thirty, or any other number of rifle-inhibit circuit combinations may be constructed as warranted by training or other operational conditions.

Moreover, in FIG. 1, inhibit circuits 19, 25, and 31 are depicted as being internal parts of simulated rifles 11, 13, and 15; however, if so desired, they may be located at any convenient place external thereof.

As disclosed in FIG. 2, trigger switch 17 is normally open, but because it is effectively connected to the trigger of simulated rifle 11 (by means not shown) it becomes closed whenever said trigger is pulled by a marksman (likewise not shown). The movable arm of switch 17 is connected through an adjustable rheostat 161 to the data (terminal No. 4) input of a CA3036 operational amplifier 163, such as is, for example, manufactured by RCA of Summerville, New Jersey. The normally open contact of switch 17 is connected to the positive plate of a battery 165, the negative plate of which is connected to the relatively negative (terminal No. 1) input of amplifier 163, one terminal of a solenoid 167, and the negative plate of another battery 169. Solenoid 167 is connected to the movable arm of a normally open switch 171, the normally open contact of which is connected to the positive plate of battery 169. A diode 173 is connected between the output of amplifier 163 and the other terminal of said solenoid 167 by means of the anode and cathode thereof, respectively. The negative plate of battery 169 is electrically connected to one of the terminals of another solenoid 175, the other terminal of which is connected to the cathode of a diode 177. The anode of said diode 177 is connected to the input of the aforesaid laser 21 and the normally closed contact of a double-pole-single-throw switch 179, the throw or movable arm of which is mechanically connected for movement by solenoid 175 when energized. The movable arm of switch 179 is also electrically connected to the movable arm of switch 171; and the normally open contact thereof is connected to one terminal of a resistance 181, one plate of a capacitance 183, one terminal of another resistance 185, and the movable arm terminal of another rheostat 187, the other terminal of which is connected to the data input of a CA3010 operational amplifier 189, likewise manufactured by RCA of Summerville, New Jersey. The other terminal of resistance 181 and the other more negative plate of capacitance 183 are interconnected and connected to the interconnected more negative (terminals Nos. 1 and 3) inputs of amplifier 189. The other terminal of resistance 185 is connected to the (terminal 9) output of amplifier 189 and a positive direct current voltage (+VDC) 191. The $V_{EE}$ (terminal No. 4) input of amplifier 189 is connected to a negative direct current voltage (−VDC) 193, and the $V_{CC}$ (terminal No. 10) input thereof is connected to the aforesaid positive direct current voltage (+VDC) 191.

Of course, with the exception of trigger switch 17 and laser 21, all of the aforesaid elements constitute a unique combination of elements which makes up inhibit circuit 19 of FIG. 1 and inhibit circuit Channel I of FIG. 2.

Again, as disclosed in FIG. 2, trigger switch 23 is normally open, but because it is effectively connected to the trigger of simulated rifle 13, it becomes closed whenever said trigger is closed by a marksman. The movable arm of switch 23 is connected through an adjustable rheostat 201 to the input of an operational amplifier 203 that is substantially identical to the aforementioned operational amplifier 163 of Channel I. The normally open electrical contact of switch 23 is connected to the positive plate of a battery 205, the negative plate of which is connected to the data (terminal No. 4) input of amplifier 203, one terminal of a solenoid 207, and the negative plate of another battery 209. Solenoid 207 is mechanically connected to the movable arm of a normally open switch 211, the normally open contact of which is connected to the positive plate of battery 209. A diode 213 is connected between the output (terminal No. 1) of amplifier 203 and the other terminal of said solenoid 207 by means of the anode and cathode thereof, respectively.

The negative plate of the aforesaid battery 209 is electrically connected to one of the terminals of another solenoid 215, the other terminal of which is connected to the cathode of a diode 217. The anode of said diode 217 is connected to the input of the aforesaid laser 27 and the normally closed contact of a double-pole-single-throw switch 219, the throw or movable arm of which is mechanically connected to solenoid 215 for movement thereby when said solenoid 25 is energized. The movable arm of switch 219 is connected to the movable arm of switch 211, and the normally open contact thereof is connected to one terminal of a resistance 221, one terminal of a capacitance 223, one terminal of another resistance 225, and the movable arm terminal of another rheostat 227, the other terminal of which is connected to the data (terminal No. 2) input of another CA3010 operational amplifier 229. The other terminal of resistance 221 and the other plate of capacitance 223 are interconnected and connected to the interconnected more negative (terminals Nos. 1 and 3) inputs of said amplifier 229. The other terminal of resistance 225 is connected to the $V_{CC}$ (terminal No. 10) output of amplifier 229 and a positive direct current voltage (+VDC) 231. The $V_{EE}$ (terminal No. 4) input of amplifier 229 is connected to a negative direct current voltage (−VDC) 233.

With the exception of trigger switch 23 and laser 27, all of the aforesaid elements constitute a unique combination of elements which makes up inhibit circuit 25 of FIG. 1 in such manner that it is substantially identical to inhibit circuit 19 discussed immediately above.

Like the above mentioned trigger switches 17 and 23, trigger switch 29 is normally open, with the movable arm thereof effectively connected to the trigger of simulated rifle 15, so that switch 29 becomes closed whenever said trigger is pulled by a marksman. The movable arm of switch 29 is connected through an adjustable rheostat 241 to the data input of an operational amplifier 243 which is substantially identical to the aforesaid operational amplifiers 163 and 203. The normally open contact of switch 29 is connected to the positive plate of a battery 245, the negative plate of which is connected to the negative input of said amplifier 243, one terminal of a solenoid 247, and the negative plate of another battery 249. Solenoid 247 is mechanically connected to the movable arm of a normally open switch 251, the normally open contact of which is connected to the positive plate of battery 249. A diode 253 is connected between the output of amplifier 243 and the other terminal of said solenoid 247 by means of the anode and cathode thereof, respectively. The negative plate of battery 249 is electrically connected to one of the terminals of another solenoid 255, the other terminal of which is connected to the cathode of a diode 257. The anode of said diode 257 is connected to the input of the aforementioned laser 33 and the normally closed contact of a double-pole-single-throw switch 259, the throw or movable arm of which is mechanically connected for the movement thereof by solenoid 255 when solenoid 255 is energized. The movable arm of switch 259 is also electrically connected to the movable arm of switch 251; and the normally open contact thereof is connected to one terminal of a resistance 261, one terminal of a capacitance 263, one terminal of another resistance 265, and the movable arm terminal of another rheostat 267, the other terminal of which is connected to the data input of another CA3010 operational amplifier 269. The other terminal of resistance 261 and the other plate of capacitance 263 are interconnected and connected to the interconnected more negative (terminals 1 and 3) inputs of amplifier 269. The other terminal of resistance 265 is connected to the $Y_{CC}$ output of amplifier 269 and a positive direct current voltage (+VDC) 271. The $V_{EE}$ input of amplifier 269 is connected to a negative direct current voltage (−VDC) 273.

Of course, as may readily be seen, with the exception of trigger switch 29 and laser 33, the aforesaid elements beginning with rheostat 241 comprise inhibit circuit 31 of FIG. 1 and inhibit Channel III of FIG. 2.

In order to inhibit for a short period of time the firing of all rifles other than the first one thereof to have its trigger pulled, inhibit circuits 19, 25, and 31 must be interconnected. In this particular case, such interconnections are specifically effected by interconnecting the cathods of diodes 177, 217, and 257. Thus, each inhibit circuit is connected to all of the others and, consequently, the operation of one thereof will inhibit or prevent the operation of all of the others, for all practical purposes, as will be explained more fully subsequently.

Figure 3:
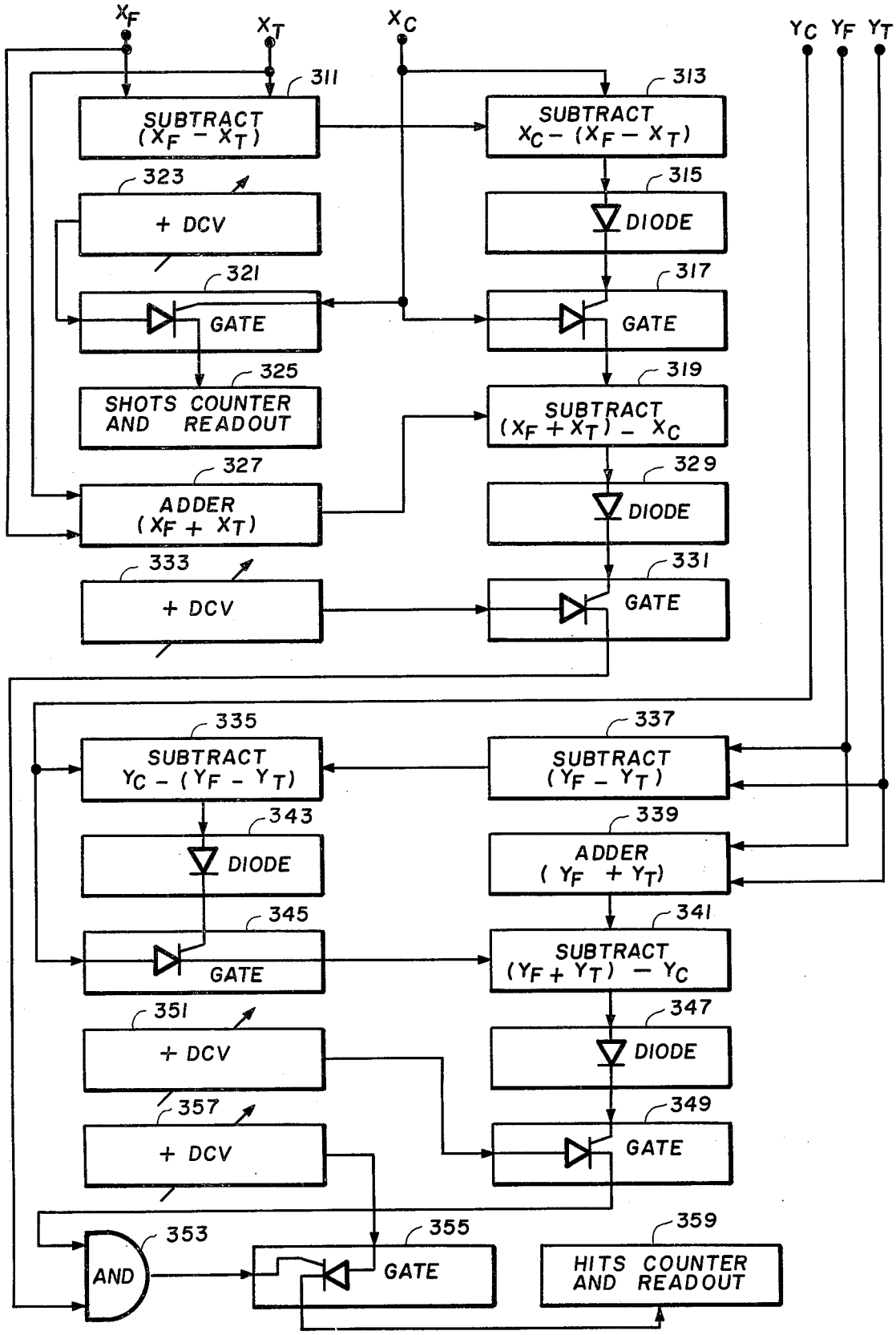
FIG. 3 illustrates in block diagram form a representative analog computer that may be used as each of the analog computers portrayed in the marksmanship training system of FIG. 1.

Referring now to FIG. 3, there is shown an ambodiment of an analog computer that may be used as analog computers 65, 95, and 125 in the system of FIG. 1. Again, in order to insure understanding, signals $X_C$ and $Y_C$ refer to the X and Y signals that emanate from digital-to-analog converters 61, 63, 91, 93, 121, and 123, respectively; therefore, if it is assumed that sub-C refers to the color of any particular receiver channel, the sub letters R, G, and B may be substituted therefor, so as to produce $X_R$, $X_G$, and $X_B$, as well as $Y_R$, $Y_G$, and $Y_B$. Thus, it may readily be seen that the $X_C$ and $Y_C$ terminals of the analog computer of FIG. 3 are intended to be connected to the X and Y outputs of the digital-to-analog converters of each of receiver channels 51, 81, and 111.

The aforesaid $X_F$ and $X_T$ signals are supplied to a pair of inputs of an $X_F-X_T$ subtract circuit 311, the output of which is connected to one of the inputs of a left hand tolerance $X_C-(X_F-X_T)$ subtract circuit 313, the other input of which has the aforesaid $X_C$ signal supplied thereto. The output of subtract circuit 313 is connected to the anode of a diode 315, the cathode of which is connected to the control input of a gate 317. The data or anode input of said gate 317 is connected to the aforesaid $X_C$ terminal, and the cathode output thereof is connected to one of the inputs of a right hand tolerance $(X_F+X_T)-X_C$ subtract circuit 319.

The aforesaid $X_C$ terminal is also connected to the control input of a gate 321, the anode input of which is connected to the output of an adjustable positive direct current voltage 323. The cathode output of gate 321 is connected to the input of a combination shots counter and readout 325.

The aforesaid $X_F$ and $X_T$ input terminals are respectively connected to a pair of inputs of an $(X_F+X_T)$ adder circuit 327, with the output thereof connected to the remaining input of the aforesaid subtract circuit 319. The output of said subtract circuit 319 is connected to the anode input of a diode 329, the cathode output of which is connected to the control input of another gate 331. Another adjustable positive direct current voltage 333 is connected to the anode input of gate 331.

A $Y_C$ terminal is connected to one of the inputs of an up tolerance $Y_C-(Y_F-Y_T)$ subtract circuit 335, a $Y_F$ input terminal is connected to one of the inputs of a $(Y_F-Y_T)$ subtract circuit 337 and to one of the inputs of a $(Y_F+Y_T)$ adder circuit 339; and a $Y_T$ terminal is connected to the other inputs of said subtract circuit 337 and said adder circuit 339. The output of subtract circuit 337 is connected to the remaining input of the aforesaid subtract circuit 335, and the output of said adder circuit 339 is connected to one of the inputs of a down tolerance $(Y_F+Y_T)-Y_C$ subtract circuit 341. The output of the aforesaid subtract circuit 335 is connected to the anode input of a diode 343, the cathode output of which is connected to the control input of a gate 345, the data or anode input of which is connected to the aforesaid $Y_C$ signal input terminal. The cathode output of gate 345 is connected to the remaining input of subtract circuit 341, and the output of subtract circuit 341 is connected to the anode input of another diode 347, with the cathode output thereof connected to the control input of still another gate 349. The remaining input of said gate 349 is connected to the output of an adjustable positive direct current voltage 351, and the cathode output of said gate 349 is connected to one of the inputs of an AND gate 353, the other input of which is connected to the output of the aforesaid gate 331. The output of AND gate 353 is connected to the control input of a gate 355, the data or anode input of which is connected to the output of another adjustable positive direct current voltage 357. The cathode output of gate 355 is connected to the input of a combination hits counter and readout 359.

Of course, in view of the foregoing, the aforesaid shots and hits counters and readouts 325 and 359 may or may not be considered as being included in the analog computer of FIG. 3. In any event, in this particular case, they should be considered as being those hits counters and readouts incorporated in each of the receiver channels of the system of FIG. 1.

Mode of Operation

The operation of the invention will now be discussed briefly in conjunction with all of the figures of the drawing.

Again, just so there is no misunderstanding, only three simulated rifles and receiver processing channels I, II, and III have been illustrated herein for the purpose of simplicity of disclosure. Consequently, it should be understood that any number thereof may be incorporated in the subject invention without violating the scope thereof, inasmuch as so doing would be obvious to the artisan who had the benefit of the teachings presented herein. Moreover, certain numbers of the simulated rifles and their respective marksmen may be deployed as any number of squads, sharpshooters, or the like. And, of course, other marksmen trainees, instructors, and other observers may also be positioned with respect to screen 41, loud speakers 47, if any, and the respective readouts in such manner as will facilitate both training and training demonstrations.

In addition, it would perhaps be noteworthy at this time that, with the exception of the inhibit circuits and the analog computers—both of which have been disclosed in detail in FIGS. 2 and 3, respectively—all of the elements and components of this invention are well known, conventional, and commercially available. Accordingly, it should be understood that, as far as this invention is concerned, it is their new and unique interconnections and interactions that effect it and cause it to produce the above stated new and improved results and objectives.

For the purpose of training three marksmen, each thereof fires one of simulated rifles 11, 13, and 15—which, of course, shoots laser light beams 35, 37, and 39, respectively, whenever they are fired—at a predefined target T that is projected on viewing screen 41, along with a background scene that represents some predetermined and probably real environmental situation, by projector 43. For the sake of this discussion, let it be assumed that the aforesaid background scene is a certain typical type of combat scene and target T is an enemy entity of some sort that is darting back and forth intermittently somewhere therein. Only one target T is employed in this particular instance, so as to cause the trainee marksmen to shoot at the same target at the same time, thereby permitting the demonstration of some highly significant elements of the invention, viz., the inhibit circuits, which cause rifles 11, 13, and 15 to actually fire one at a time, and successively, even though the triggers thereof have been pulled almost simultaneously or at least simultaneously enough that it would be exceedingly difficult, if not impossible, to tell who hit the target.

For the purpose of this discussion, let it be assumed that trigger switches 17 and 23 were closed almost simultaneously as a result of the marksmen pulling the triggers of simulated rifles 11 and 13 almost simultaneously. Also, let it be assumed that, although said marksmen could not tell the difference, the first marksman pulled the trigger of rifle 11, say, a tenth of a second before the second marksman pulled the trigger of rifle 13. Hence, trigger switch 17 was closed ever so slightly before trigger switch 23 was closed. As best seen in FIG. 2 in such case, the closure of switch 17 causes a positive electrical pulse from battery 165 to be applied to the input of amplifier 163 which causes it to be amplified to a more useful level before being supplied through diode 173 to solenoid 167, and back to battery 165, thereby completing the electrical circuit and energizing solenoid 167. The energization of solenoid 167 causes switch 171 to be closed which, in turn, causes battery 169 to supply an electrical pulse through normally closed switch 179 to laser 21, so as to effect the firing thereof. At the same time laser 21 is fired, the electrical pulse that fired it also passed through diode 177 to energize solenoid 215 of inhibit circuit 25 and to energize solenoid 175 of inhibit circuit 19. The energization of solenoid 215 causes switch 219 to open the upper contact and close the lower contact, thereby preventing any pulse from battery 209 from passing therethrough and firing laser 27 at the same time laser 21 is fired. The changing of switch 179 from engagement with the upper contact to the lower contact causes the same thing to happen in inhibit circuit 19 as happens in inhibit circuit 25 when switch 219 is likewise changed therewith. However, since trigger switch 17 has already been pulled or closed and laser 21 has already been fired, the operational effect within inhibit circuit 19 has no practical effect until trigger switch 17 is again closed as a result of the trigger of laser rifle 11 having been pulled for the second time. Therefore, only what happens within inhibit circuit 25 will now be discussed, inasmuch as the same discussion could be applied to inhibit channel 19 (and to inhibit channel 31, for that matter) and should be readily understood by the artisan as a consequence thereof.

When switch 219 has changed position, as a result of trigger switch 23 having been closed by the marksman firing rifle 13 at almost the same time but very slightly after rifle 11 was fired (as previously mentioned), switch 211 has been closed, and battery 209 supplies an electrical pulse via the now closed lower contact of switch 219 to the data input and through an electrical delay circuit comprising resistance 221, capacitance 223, resistance 225, and rheostat 227, with said resistance 221 and 225 functioning in conjunction with plus and minus direct current voltages 231 and 233 to effect a predetermined thresholder. In any event, when the aforesaid electrical pulse timely builds up enough, amplifier 229 is fired, thereby closing the circuit to the negative plate of batteries 205 and 209, and, thus, energizing solenoid 207 and again closing switch 211, which had opened during the aforesaid delay. But, in the meantime, switch 219 has changed back to the top contact being closed, so the second closure of switch 211 causes battery 209 to supply an electrical pulse therethrough and through switch 219 to fire laser 27. Of course, the pulse that fires laser 27 inhibits the firing of laser 21 because it also energizes solenoid 175, opening the top contact of switch 179.

For a similar reason—that is, because the pulse that fires laser 27, in fact, inhibits the firing of lasers 21 and 33—rifle 15 would not fire at that time, in the event all three simulated rifles 11, 13, and 15 were being almost simultaneously fired by three marksmen instead of two. Hence, it may readily be seen from the above that the firing of the first rifle, regardless of which one it is, inhibits the firing of any or all of the others for a predetermined delayed period of time, after which they fire in the sequence in which their triggers were pulled, with, say, a thirtieth of a second delay therebetween.

In the foregoing specific example, a red spot would first appear momentarily on screen 41—either on or off target, according to the skill of the marksman—immediately after which a green spot would momentarily appear thereon, since, in this instance, only two rifles were being fired at approximately the same time. Again, for purposes of emphasis, similar operational procedures would be effective if three or more rifles were being fired at target T by as many marksmen. Therefore, whoever was the best marksman may be more easily perceived because the laser shot colors may be more readily distinguished, both visually by the human eye and instrumentally by the receiver channels that will now be discussed.

Because receiver channels 51, 81, and 111 all perform their respective functions in substantially the same manner, only the operation of channel 51 (the red responsive channel) will be described in detail, thereby keeping this disclosure as simple as possible.

Assuming that the aforesaid red laser rifle 11 has been fired and that a resulting red laser beam spot momentarily exists on and is reflected from screen 41, said reflected red light is received by red filter 53. Because red filter 53 has been selected to pass only the frequency of red light produced by red laser 21, filter 53 acts as a narrow band pass filter and, thus, stops all other frequencies or colors, including the scene created by projector 43. Hence, all shots fired by simulated rifle 11 are effectively picked off or sensed by red filter 53 and only red filter 53. The red laser light passed by said filter 53 travels on down the aforementioned first optical path (which, of course, is the only optical path through channel 51) to ND filter 55. In the event its intensity is great enough—and it always will be when the red laser has been activated—it passes through neutral density (ND) filter 55, inasmuch as said filter 55 acts as a thresholder that passes only the light within the narrow red band which exceeds a preset amount—i.e., only the amount of red laser light that is bright enough to be "seen" by a data digitizer of the above mentioned 658A type.

The red light that passes through ND filter 55 travels to digitizer 57. In synchronism with the aforementioned projector 43, as a result of being effectively connected thereto by means of frame lock 59, data digitizer 57 senses and operates on the optical input of said spot of passed red light and converts it to the binary equivalent of a two dimensional optical image thereof in the form of "X" and "Y" coordinate signals which represent the digital position of the red spot on screen 41 with respect to predetermined imaginary or real abscissa and ordinate reference datums associated therewith. Accordingly, at this point in the process, the position of the red spot shot from rifle 11 is digitally "known" by digitizer 57 with respect to target T because the position of target T is constantly known with respect to the aforesaid abscissa and ordinate datums, due to the synchronization of digitizer 57 with projector 43 (and the indexed film projected thereby) by frame lock 59. The aforesaid "X" and "Y" digital signals are converted to "$X_R$" and "$Y_R$" electrical analog signals respectively proportional thereto, and, as previously mentioned, it is those signals which are the data signals that are supplied to the $X_C$ and $Y_C$ input terminals of analog computer 65, a block diagram of which is depicted in FIG. 3. Obviously, as also previously mentioned, for channel 51, the sub-C refers to the color to which it is responsive. In this case, the color C is red, or "R"; hence, the "$X_R$" and "$Y_R$" outputs of digital-to-analog-converters 61 and 63 are connected to the "$X_C$" and "$Y_C$" inputs of the analog computer of FIG. 3, the latter of which, of course, may be substituted for analog computers 95 and 125, as well.

In addition to the aforesaid $X_R$ and $Y_R$ signals, $X_F$ and $Y_F$ signals which are originated by projector 43 (and which represent the true location of target T at any given instant), and $X_T$ and $Y_T$ signals which are respectively originated by adjustable positive direct current voltage generators 67 and 69 are supplied to the like-named terminals of the embodiment of analog computer 65 shown in FIG. 3.

The operation of analog computer 65 begins with the direct current pulse $X_F$ being entered into subtract 311. At the same time, a tolerance direct current pulse $X_T$ is entered into said subtract 311 from positive direct current voltage source 67, after which signal $X_T$ is subtracted from $X_F$ thereby, and the difference thereof entered into subtract circuit 313, along with signal $X_C$ from digital-to-analog converter 61, with $X_C$ equaling $X_R$ in this particular instance because red channel 51 is being discussed. The left hand tolerance difference of $X_C-(X_F-X_T)$ is, of course, obtained from subtract circuit 313 and constitutes the distance left of target T which will be considered a hit thereon by the red laser shot. Of course, since voltage $X_T$ is adjustable, said left hand tolerance is adjustable, too. If it is negative, it will not pass through diode 315, thereby meaning that the red spot on screen 41 falls outside predetermined tolerance limits; but if it is positive, meaning that the red spot on screen 41 falls within predetermined tolerance limits, then it will pass through diode 315 to the control input of control gate 317 to effect the opening thereof. The opening of gate 317 allows signal $X_C$ to pass therethrough and be entered into right hand tolerance subtract circuit 319, along with the sum $X_F$ and $X_T$ obtained from adder 327, the $X_F$ and $X_T$ inputs of which were previously obtained from projector 43 and direct current voltage source 67, respectively. Of course, subtract circuit 319 performs the function of $(X_F+X_T)-X_C$ in a conventional manner. If the difference signal thereof is negative, it will not pass diode 329, thereby indicating that the red shot relative to target T was outside a predetermined right hand tolerance distance therefrom; on the other hand, if it is positive, indicating that the red spot is within said predetermined right hand tolerance, it passes through diode 329 to the control input of control gate 331 to effect the opening thereof. When gate 331 is open a positive direct current voltage from source 333 is supplied to one of the inputs of AND gate 353.

In exactly the same manner the Y location of the red spot on screen 41—$Y_C$ representing $Y_R$ from digital-to-analog converter 63, in this particular instance—is checked by components 335 through 351 to determine if it falls within predetermined up and down tolerance limits; consequently, it will not be discussed in greater detail at this time, in order to reduce the size of this disclosure. Nevertheless, it should perhaps be mentioned that $Y_C$ falls outside said tolerance limits if the output from either subtract circuit 335 or 341 is negative and inside them if positive, the latter of which is then supplied to gate 349 to open it. Opening gate 349 permits the positive direct current voltage signal from source 357 to be supplied to the remaining input of the aforesaid AND gate 353, thereby enabling it, so as to cause the output signal therefrom to open control gate 355. Of course, the opening of control gate 355 permits a direct current voltage pulse to be supplied to "hits" counter and readout 359, thus effecting a target T hit count and indication thereby.

It would obviously be of considerable assistance for the trainee marksman to know how many times he hit target T; and, of course, it would be of even greater significance if he were aware of how many times he hit target T out of how many shots. Accordingly, analog computer 65 has also been constructed to compute the number of shots fired by laser rifle 11. For effecting such calculation, the $X_R$ (or $X_C$) input signal is data processed therein as follows:

Signal $X_R$ is supplied via the $X_C$ terminal to the control input of gate 321, so as to timely cause the opening thereof as each red laser shot is fired from simulated rifle 11. Upon being opened, a positive direct current voltage pulse from source 323 passes therethrough to shots counter and readout 325. The latter tallies the number of such voltage pulses received and indicates them in terms of total number of shots fired during any given period of time.

Although the aforementioned gate 321 operates on $X_R$ pulses in this particular embodiment, it could just as easily operate on $Y_R$ (that is, $Y_C$) pulses, inasmuch as the $X_R$ and $Y_R$ pulses from digital-to-analog converters 61 and 63 occur simultaneously, because they have both been effectively generated in response to the same red laser light spot on screen 41. Obviously, it would be well within the purview of the artisan having the teachings presented herewith to design the analog computer of FIG. 3 in such manner as to make gate 321 responsive to $Y_R$ signals instead of $X_R$ signals, if so desired.

Referring back to FIG. 1, it may readily be seen that separate hits and shots counters and readouts have been employed, in order to expressly give such design latitude to the artisan. Hence, if preferred during any given circumstances, hits counters 71 and 73 and readouts 75 and 77 may be substituted for hits counter and readout and shots counter and readout 359 and 325, respectively, although in this case, the former are shown in FIG. 1 and the latter are portrayed in FIG. 3.

In any event, from the above, it may readily be seen that the X and Y location coordinates of target T from projector 43 and the film projected thereby are effectively correlated with the X and Y location coordinates of the red laser light spot shot onto screen 41 by simulated gun 11, and, therefore, target hits and misses can be and are computed and appropriately indicated, along with the number of shots fired.

With the exception of the colors being processed thereby—and, hence, the color filters incorporated therein, respectively—receiver channels 51, 81, and 111 are substantially identical. Accordingly, they all operate in the same way as the above discussed red channel 51 operates. Consequently, for simplicity of disclosure purposes, further detailed discussions thereof are deemed unnecessary.

To further facilitate the training of rifle (or other weapon) marksmen, it has been found that shooting reviews are often quite valuable, both for the shooting marksmen and observers. Therefore, during firing sessions, color TV camera 143 shoots whatever action occurred on screen 41, and at the same time, video tape recorder 151 makes a tape recording thereof which may be played back at any convenient time by means of TV monitor and readout 153. Hence, "post mortums" may be held, with or without benefit of instructors, which will depict and possibly stimulate discussions with respect to what was done wrong and, thus, provide a teaching of how to do it right.

In view of the foregoing, it may readily be seen that a new, unique, and highly useful marksmanship training system has been invented which produces results which are a vast improvement over the aforementioned prior art, thereby effecting an advancement of the art.

Obviously, many modifications and variations of the present invention are possible in light of the above teachings. It is, therefore, to be understood that within the scope of the appended claims the invention may be practiced otherwise than as specifically described.

What is claimed is:

1. A marksmanship training system, comprising in combination:

means for receiving and reflecting radiant energy within a predetermined frequency range;

means spatially disposed from said radiant energy receiving and reflecting means for projecting a motion picture scene intermittently containing a predetermined target image thereon in such manner as to be reflected thereby, having a synchronization output;

means spatially disposed from said radiant energy receiving and reflecting means for firing shots of radiant energy having a predetermined frequency thereat and at the aforesaid reflected target image, comprising a plurality of simulated rifles, each of which is adapted for firing shots of radiant energy of a color different from that of the others;

means spatially disposed from said radiant energy receiving and reflecting means and connected to outputs of the aforesaid projecting means for receiving reflected images of the radiant energy shots fired at said reflected target image in coordinated synchronism with the projection of said reflected target image and for producing a pair of output signals respectively proportional to the X and Y coordinate distances of said reflected shots from said reflected target image, comprising;

an optical filter adapted for receiving and filtering that frequency of radiant energy shots fired from the aforesaid firing means;

a neutral density filter spatially disposed along a first predetermined optical path from said last mentioned filter;

a digitizer having a pair of inputs and a pair of outputs spatially disposed from the aforesaid neutral density filter along said first optical path in such manner that one of said inputs is optically responsive to that radiant energy received therefrom;

a frame lock connected between the synchronization output of the aforesaid projecting means and the remaining input of said digitizer;

a first digital-to-analog converter connected to one of the outputs of said digitizer; and a second digital-to-analog converter connected to the other output of said digitizer;

means connected to the output of said last mentioned means for computing the number of times said radiant energy shots hit said reflected intermittent target image and the number of radiant energy shots fired per given period of time; and means connected to the outputs of said computing means for reading out the number of times said radiant energy shots hit said reflected target image and the number of shots fired during said given time period.

2. The device of claim 1, wherein said means for receiving and reflecting radiant energy within a predetermined frequency range comprises a viewing screen.

3. The device of claim 1, wherein said means spatially disposed from said energy receiving and reflecting means for projecting a motion picture scene intermittently containing a predetermined target image thereon in such manner as to be reflected thereby comprises:

a projector; and a film disposed within said projector for projection thereby.

4. The device of claim 1, wherein said means spatially disposed from said energy receiving and reflecting means for projecting a motion picture scene intermittently containing a predetermined target image thereon in such manner as to be reflected thereby comprises:

a projector;

a film disposed within said projector for projection thereby; and means effectively incorporated within said film adapted for producing a predetermined audio signal in correlation therewith.

5. The device of claim 1, wherein said means spatially disposed from said energy receiving and reflecting means for firing shots of radiant energy having a predetermined frequency thereat and at the aforesaid reflected target image comprises at least one simulated rifle.

6. The device of claim 1, wherein said means spatially disposed from said energy receiving and reflecting means for firing shots of radiant energy having a predetermined frequency thereat and at the aforesaid reflected target image comprises at least one simulated weapon.

7. The device of claim 1, wherein said means spatially disposed from said radiant energy receiving and reflecting means and connected to the outputs of the aforesaid projecting means for receiving reflected images of the radiant energy shots fired at said reflected target image in coordinated synchronism with the projecting of said reflected target image and for producing a pair of signals respectively proportional to the X and Y coordinate distances of said reflected shots from said reflected target image comprises at least one receiver channel.

8. The device of claim 1, wherein said means connected to the output of said last mentioned means for computing the number of times said radiant energy shots hit said reflected intermittent target image and the number of radiant energy shots fired per given period of time, comprises:

an analog computer having a trio of pairs of inputs and a pair of outputs, with one of the pairs of inputs thereof respectively connected to the outputs of the aforesaid first and second digital-to-analog converters, with another of the pairs of inputs thereof adapted for being connected to a predetermined pair of direct current voltages, respectively, and the remaining pair of inputs thereof respectively connected to a pair of data outputs of the aforesaid projecting means;

a hits counter connected to one of the outputs of said analog computer; and a shots counter connected to the other output of said analog computer.

9. The device of claim 1, wherein said shots of radiant energy having a predetermined frequency comprise laser light.

10. The invention of claim 1, further characterized by means connected to the audio output of said projecting means for broadcasting sonic energy in response to an audio signal therefrom in predetermined proximity with the aforesaid radiant energy shots firing means.

11. A marksmanship training system, comprising in combination:

a viewing screen adapted for receiving and reflecting radiant energy within the visible frequency spectrum;

means, including a film, spatially disposed from said viewing screen for projecting a scene thereon that intermittently includes a predetermined target located at a predetermined position therewithin;

a plurality of simulated rifles adapted for shooting a like plurality of different color laser light shots, respectively, upon the pulling of the respective triggers thereof by a like plurality of marksmen;

a plurality of receiving means spatially disposed from said viewing screen and connected to outputs of said projecting means for respectively receiving the images of said different color laser light shots after the reflection thereof from said viewing screen and for producing a like plurality of pairs of signals respectively proportional to the X and Y coordinate distances of said reflected different color laser light shots from the intermittently projected target reflected from said viewing screen, comprising;

an optical filter adapted for receiving and filtering one of the aforesaid different color laser light shots;

a neutral density filter spatially disposed along a given optical axis for receiving that color of radiant energy passed by the aforesaid optical filter;

a digitizer having an optical input, a synchronization input, and a pair of outputs, with the optical input thereof disposed along said given optical axis in such manner as to be responsive to that radiant energy passed by the aforesaid neutral density filter;

a frame lock connected between the synchronization input of said digitizer and the synchronization output of the aforesaid projector;

a first digital-to-analog converter connected to one of the outputs of said digitizer for producing an analog signal representing the X coordinate distance of that laser light color passed by the aforesaid first mentioned optical filter from a first reference datum; and a second digital-to-analog converter connected to the other output of said digitizer for producing another analog signal representing the Y coordinate distance of the laser light color passed by the aforesaid first mentioned optical filter from a second reference datum;

a plurality of means respectively connected to the outputs of said plurality of receiving means, a pair of positive direct current voltage sources, and the aforesaid projecting means for computing the number of times said different color laser light shots hit said reflected target and the number of said different color shots fired, respectively, for a given period of time; and a plurality of readouts respectively connected to the outputs of the aforesaid plurality of computing means for indicating the number of times said different color laser light shots hit said reflected target and the number of shots thereof fired during said given period of time, respectively.

12. The device of claim 11, wherein each of said plurality of means respectively connected to the outputs of said plurality of receiving means and the aforesaid projecting means for computing the number of times said different color laser light shots hit said reflected target and the number of said different color shots fired, respectively, for a given period of time comprises:

an analog computer;

a hits counter connected to one of the outputs of said analog computer; and a shots counter connected to the other output of said analog computer.

13. The device of claim 11, wherein said plurality of readouts respectively connected to the outputs of the aforesaid plurality of computing means for indicating the number of times said different color laser light shots hit said reflected target and the number of shots thereof fired during said given period of time, respectively, comprise a pair of indicators respectively calibrated in terms of numerical hits and shots.

14. The invention of claim 11, further characterized by:

a color television camera spatially disposed from said viewing screen in such manner as to continuously observe the action thereon;

a video tape recorder connected to the output of said color television camera; and a video tape player effectively connected to the output of said video tape recorder for timely playing back any video data recorded by said video tape recorder.

15. The invention of claim 11, further characterized by means respectively connected to the aforesaid plurality of simulated rifles for inhibiting the firing of the remainder thereof for predetermined delay periods upon the firing of any one thereof.

16. The device of claim 15, wherein said inhibiting means comprises a plurality of interconnected inhibit circuits, the number of which is equal to the number of the aforementioned simulated rifles.

17. The device of claim 11, wherein each of said plurality of simulated rifles comprises:

a trigger switch adapted for being closed upon the pulling of the trigger thereof; and a laser effectively connected to the output of said trigger switch.

18. The invention of claim 17, further characterized by:

an inhibit circuit connected between the output of said trigger switch and the input of said laser; and means interconnecting all of the inhibit circuits of all of the aforesaid plurality of simulated rifles for timely providing inhibit type control signals therebetween.

19. A marksmanship training system, comprising in combination:

a first simulated rifle having a first trigger switch, a first inhibit circuit having an input, a pair of input-outputs, and an output, with the input thereof connected to the output of said first trigger switch, and a red laser connected to the output of said first inhibit circuit;

a second simulated rifle having a second trigger switch, an inhibit circuit having an input, a pair of input-outputs, and an output, with the input thereof connected to the output of said trigger switch, and with one of the input-outputs thereof connected to one of the input-outputs of the aforesaid first inhibit circuit, and a green laser connected to the output of said second inhibit circuit;

a third simulated rifle having a third trigger switch, a third inhibit circuit having an input, a pair of input-outputs, and an output, with the input thereof connected to the output of said third trigger switch, with one of the input-outputs thereof connected to the other of the input-outputs of the aforesaid first inhibit circuit and the other of the input-outputs thereof connected to the other of the input-outputs of the aforesaid second inhibit circuit, and a blue laser connected to the output thereof;

a target screen spatially disposed from said first, second, and third simulated rifles;

a film and sound projector spatially disposed from said target screen in such manner as to project filmed background and target images thereon, said projector being adapted for producing a pair of data signals, a sync signal, and an audio signal;

a red optical filter spatially disposed from the aforesaid target screen in such manner as to receive all images reflected therefrom;

a first neutral density filter spatially disposed along a first optical path from said red optical filter;

a first digitizer having an optical input spatially disposed along said first optical path from said first neutral density filter, a sync input, and a pair of outputs;

a first frame lock connected between the sync output of the aforesaid projector and the sync input of said first digitizer;

a first pair of digital-to-analog converters respectively connected to the outputs of said first digitizer;

a first positive direct current voltage;

a second positive direct current voltage;

a first analog computer having a trio of pairs of inputs and a pair of outputs, with one of the pairs of inputs thereof respectively connected to the pair of data outputs of the aforesaid projector, with another of the pairs of inputs thereof respectively connected to the outputs of said first and second positive direction current voltages, and with the remaining pairs of inputs thereof respectively connected to the outputs of said first pair of digital-to-analog converters;

a first hits counter connected to one of the outputs of said first analog computer;

a first shots counter connected to the other output of said first analog computer;

first readout means connected to the outputs of said first hits and shots counters;

a green optical filter spatially disposed from the aforesaid target screen in such manner as to receive all images reflected therefrom;

a second neutral density filter spatially disposed along a second optical path from said green optical filter;

a second digitizer having an optical input spatially disposed along said second optical path from said second neutral density filter, a sync input, and a pair of outputs;

a second frame lock connected between the sync output of the aforesaid projector and the sync input of said second digitizer;

a second pair of digital-to-analog converters respectively connected to the outputs of said second digitizer;

a second analog computer having a trio of pairs of inputs and a pair of outputs, with one of the pairs of inputs thereof respectively connected to the outputs of said first and second positive direct current voltages, and with the remaining pairs of the inputs thereof connected to the outputs of said second pair of digital-to-analog converters;

a second hits counter connected to one of the outputs of said second analog computer;

a second shots counter connected to the other output of said second analog computer;

second readout means connected to the outputs of said second hits and shots counters;

a blue optical filter spatially disposed from the aforesaid target screen in such manner as to receive all images reflected therefrom;

a third neutral density filter spatially disposed along a third optical path from said third optical filter;

a third digitizer having an optical input spatially disposed along said third optical path from said third neutral density filter, a sync input, and a pair of outputs;

a third frame lock connected between the sync output of the aforesaid projector and the sync input of said third digitizer;

a third pair of digital-to-analog converters respectively connected to the outputs of said third digitizer;

a third analog computer having a trio of pairs of inputs and a pair of outputs, with one of the pairs of inputs thereof respectively connected to the pair of data outputs of the aforesaid projector, with another of the pairs of inputs thereof respectively connected to the outputs of said first and second positive direct current voltages, and with the remaining pairs of inputs thereof respectively connected to the outputs of said third pair of digital-to-analog converters;

a third hits counter connected to one of the outputs of said third analog computer;

a third shots counter connected to the other output of said analog computer; and third readout means connected to the outputs of said third hits and shots counters.

20. The device of claim 19, wherein each of the aforesaid inhibit circuits of said first, second, and third simulated rifles comprises:

an adjustable rheostat, one terminal of which is adapted for being connected to one terminal of a normally open trigger switch;

a first operational amplifier having a pair of inputs and an output, with one of the inputs thereof connected to the other terminal of said adjustable rheostat;

a first battery having a positive terminal and a negative terminal, with the positive terminal thereof adapted for being connected to the normally open contact of the aforesaid trigger switch, and with the negative terminal thereof connected to the other input of said first operational amplifier;

a first relay solenoid, with one terminal thereof connected to the negative terminal of said first battery;

a first diode having an anode and a cathode, with the anode thereof connected to the output of said first operational amplifier, and with the cathode thereof connected to the other terminal of said first relay solenoid;

a secondary battery having a negative terminal and a positive terminal, with the negative terminal thereof connected to the negative terminal of the aforesaid first battery;

a first normally open relay switch having a normally open contact and a movable arm, with the normally open contact thereof connected to the positive pole of the aforesaid second battery, and with the movable arm thereof effectively mechanically connected to the aforesaid first relay solenoid in such manner as to close said first normally open relay switch upon energization thereof;

a second relay solenoid, one terminal of which is connected to the negative terminal of said second battery;

a second diode having an anode and a cathode, with the cathode thereof connected to the other terminal of said second relay solenoid, and with the anode thereof adapted for being connected to the input of a laser;

a single-throw-double-pole switch having a normally closed contact, a normally open contact, and an arm movable therebetween, with the movable arm thereof effectively mechanically connected to the aforesaid second relay solenoid in such manner as to be moved into contact with the normally open contact thereof in response to the energization of said second relay solenoid, and with the movable arm thereof connected to the movable arm of the aforesaid second relay switch;

a second adjustable rheostat, with the movable arm terminal thereof connected to the normally open contact of said single-throw-double-pole relay switch;

a second operational amplifier having a plurality of inputs and an output, with one of the inputs thereof connected to the other terminal of said second adjustable rheostat, and with the output thereof connected to the cathode of the aforesaid first diode;

a positive direct current voltage connected to one of the inputs of said second operational amplifier;

a first resistance connected between said positive direct current voltage and the movable arm of said adjustable rheostat;

a second resistance connected between the movable terminal of said adjustable rheostat and a predetermined interconnected pair of the inputs of said second operational amplifier;

a capacitance, with one plate thereof connected to the movable arm of said second adjustable rheostat, and with the other plate thereof connected to said interconnected pair of inputs of said second operational amplifier; and a negative direct current voltage connected to the remaining input of said second operational amplifier.

21. The device of claim 19, wherein each of the first, second, and third analog computers comprises:

a first input terminal adapted for receiving an $X_F$ signal from one of the data output terminals of the aforesaid projector, with said $X_F$ signal being proportional to an X-axis coordinate distance between the target images projected by said projector and the laser light shots fired from said first, second, and third simulated rifles that are reflected from the aforesaid target screen;

a second input terminal adapted for receiving a $Y_F$ signal from the other of the data output terminals of the aforesaid projector, with said $Y_F$ signal being proportional to a Y-axis coordinate distance between the target images projected by said projector and the laser light shots fired from said first, second, and third simulated rifles that are reflected from the aforesaid target screen;

a third input terminal adapted for receiving an $X_T$ signal representing the aforesaid first positive direct current voltage;

a fourth input terminal adapted for receiving a $Y_T$ signal representing the aforesaid second positive direct current voltage;

a fifth input terminal adapted for receiving an $X_C$ signal from the output of said first digital-to-analog converter, with said $Y_C$ signal being an analog signal that is proportional to an X-axis coordinate distance between the target images projected by the aforesaid projector and the laser light shots, regardless of color, fired from any one of said first, second, and third simulated rifles that is reflected from the aforesaid target screen;

a sixth input terminal adapted for receiving a $Y_C$ signal from the output of said second digital-to-analog converter, with said $Y_C$ signal being an analog signal that is proportional to a Y-axis coordinate distance between the target images projected by the aforesaid projector and the laser light shots, regardless of color, fired from any one of said first, second, and third simulated rifles that is reflected from the aforesaid target screen;

an $(X_F-X_T)$ subtract circuit having a pair of inputs and an output, with the inputs thereof connected to the aforesaid first and third terminals;

an $X_C-(X_F-X_T)$ subtract circuit having a pair of inputs and an output, with the inputs thereof respectively connected to the output of said $(X_F-X_T)$ substract circuit and the aforesaid fifth terminal;

a first diode having an anode and a cathode, with the anode thereof connected to the output of said $X_C-(X_F-X_T)$ subtract circuit;

a gate having an anode input, a control input, and a cathode output, with the anode input thereof connected to the aforesaid fifth terminal, and with the control input thereof connected to the cathode output of said first diode;

an $(X_F+X_T)-X_C$ subtract circuit having a pair of inputs and an output, with one of the inputs thereof connected to the cathode output of the aforesaid gate;

an $(X_F+X_T)$ adder circuit having a pair of inputs and an output, with the inputs thereof respectively connected to the aforesaid first and third terminals, and with the output thereof connected to the other input of said $(X_F+X_T)-X_C$ subtract circuit;

a second diode having an anode and a cathode, with the anode thereof connected to the output of said $(X_F+X_T)-X_C$ subtract circuit;

a second gate having an anode input, a control input, and a cathode output, with the control input thereof connected to the cathode output of said second diode;

a first adjustable positive direct current voltage source connected to the anode input of said second gate;

a second positive direct current voltage source;

a third gate having an anode input, a control input, and a cathode output, with the anode input thereof connected to the output of said second adjustable positive direct current voltage source, with the control input thereof connected to the aforesaid fifth terminal, and the cathode output thereof adapted for being connected to the input of a shots counter and readout;

a $(Y-T)$ subtract circuit having a pair of inputs and an output, with the inputs thereof respectively connected to the aforesaid second and fourth terminals;

a $Y_C-(Y_F-Y_T)$ subtract circuit having a pair of inputs and an output, with one of the inputs thereof connected to the aforesaid sixth terminal, and with the other input thereof connected to the output of said $(Y_F-Y_T)$ subtract circuit;

a third diode having an anode and a cathode, with the anode thereof connected to the output of a $(Y_C-Y_T)$ subtract circuit;

a $(Y_F+Y_T)$ adder circuit having a pair of inputs and an output, with the inputs thereof respectively connected to the aforesaid second and fourth terminals;

a $(Y_F+Y_T)-Y_C$ subtract circuit having a pair of inputs and an output, with one of the inputs thereof connected to the output of said $(Y_F+Y_T)$ adder circuit;

a fourth gate having an anode input, a control input, and a cathode output, with the anode input thereof connected to the aforesaid sixth terminal, with the control input thereof connected to the cathode of said third diode, and with the output thereof connected to the other input of said $(Y_F+Y_T)-Y_C$ subtract circuit;

a fourth diode having an anode input and a cathode output, with the anode input thereof connected to the output of said $(Y_F+Y_T)-Y_C$ subtract circuit;

a third adjustable positive direct current voltage;

a fifth gate having an anode input, a control input, and a cathode output, with the anode input thereof connected to the output of said third adjustable positive direct current voltage source, and with the control input thereof connected to the output of said fourth diode.

an AND gate having a pair of inputs and an output, with one of the inputs thereof connected to the cathode output of said second gate, and with the outer input thereof connected to the cathode output of the aforesaid fifth gate;

a fourth adjustable positive direct current voltage source;

a sixth gate, having an anode input, a control input, and a cathode output, with the anode input thereof connected to the output of said fourth adjustable positive direct current voltage source, with the control input thereof connected to said AND gate, and with the cathode output thereof adapted for being connected to a hits counter and readout.

22. The device of claim 19, wherein each of said first, second, and third analog computers comprises:

a plurality of input terminals herewith designated as being terminal $X_F$, terminal $Y_F$, terminal $X_T$, terminal $Y_T$, terminal $X_C$, and terminal $Y_C$, respectively;

a first subtract circuit having a pair of inputs and an output, with the inputs thereof respectively connected to the aforesaid $X_F$ and $X_T$ input terminals;

a second subtract circuit having a pair of inputs and an output, with one of the inputs thereof connected to the output of said first subtract circuit, and with the other input thereof connected to the aforesaid $X_C$ input terminal;

a first diode connected to the output of said second subtract circuit;

a first gate having a data input, a control input, and an output, with the data input thereof connected to the aforesaid $X_C$ input terminal, and with the control input thereof connected to the output of said first diode;

a third subtract circuit having a pair of inputs and an output, with one of the inputs thereof connected to the output of said first gate;

a first adder circuit having a pair of inputs and an output, with the inputs thereof respectively connected to the aforesaid $X_F$ and $X_T$ input terminals, and with the output thereof connected to the other input of said third subtract circuit;

a second diode connected to the output of said third subtract circuit;

a first adjustable positive direct current voltage source;

a second gate having a data input, a control input, and an output, with the data input thereof connected to the output of said first adjustable positive direct current voltage, and with the control input thereof connected to the output of said second diode;

a second adjustable positive direct current voltage source;

a third gate having a data input, a control input, and an output, with the data input thereof connected to the output of said second adjustable positive direct current voltage, and with the control input thereof connected to the aforesaid $X_C$ input terminal;

a fourth subtract circuit having a pair of inputs and an output, with the inputs thereof respectively connected to the aforesaid $Y_F$ and $Y_T$ input terminals;

a fifth subtract circuit having a pair of inputs and an output, with one of the inputs thereof connected to the output of said fourth subtract circuit, and with the other input thereof connected to the aforesaid $Y_C$ input terminal;

a second adder circuit having a pair of inputs and an output, with the inputs thereof respectively connected to the aforesaid $Y_F$ and $Y_T$ input terminals;

a sixth subtract circuit having a pair of inputs and an output, with one of the inputs thereof connected to the output of said second adder circuit;

a third diode connected to the output of said fifth subtract circuit;

a fourth gate having a data input, a control input, and an output, with the data input thereof connected to the aforesaid $Y_C$ input terminal, with the control input thereof connected to the output of said third diode, and with the output thereof connected to the other input of said sixth subtract circuit;

a fourth diode connected to the output of said sixth subtract circuit;

a third adjustable positive direct control voltage source;

a fifth gate having a data input, a control input, and an output, with the data input thereof connected to the output of said third adjustable positive direct current voltage source, with the control input thereof connected to the output of said fourth diode;

an AND gate having a pair of inputs and an output, with the inputs thereof respectively connected to the outputs of said second and fifth gates;

a fourth adjustable positive direct current voltage source;

a sixth gate having a data input, a control input, and an output, with the data input thereof connected to the output of said fourth adjustable positive direct current voltage source, and with the control input thereof connected to the output of said AND gate.

23. The invention of claim 22, further characterized by:

a first utilization apparatus connected to the output of said third gate; and a second utilization apparatus connected to the output of the aforesaid sixth gate.

24. The invention of claim 23, furtther characterized by means spatially disposed from said target screen and effectively connected to the sync signal output of said projector for recording and playing back the optical images projected and shot thereon by said projector and the aforesaid first, second, and third rifles, respectively.

25. The invention of claim 19, further characterized by a loud speaker connected to the audio output of said projector.

26. A marksmanship training system, comprising in combination:

a first simulated weapon having a series connected first trigger switch, first inhibit circuit having at least one input and one output, and first predetermined color laser, with the first trigger switch thereof adapted for being closed whenever the trigger of said first simulated weapon is pulled, so as to effect the energization and firing of said first predetermined color laser, with the first inhibit circuit thereof adapted for timely and effectively disconnecting said first predetermined color laser from said first trigger switch in such manner as to prevent the firing thereof in response to a first inhibit signal and for generating a second inhibit signal upon the firing of said first predetermined color laser;

a second simulated weapon having a series connected second trigger switch, second inhibit circuit having at least one input and one output, and second predetermined color laser, with the second trigger switch thereof adpated for being closed whenever the trigger of said second simulated weapon is pulled, so as to effect the energization and firing of said second predetermined color laser, with the second inhibit circuit thereof adapted for timely and effectively disconnecting said second predetermined color laser from said second trigger switch in such manner as to prevent the firing thereof in response to the aforesaid second inhibit signal and for generating the aforesaid first inhibit signal upon the firing of said second predetermined color laser;

means connected between an output of said first inhibit circuit and the control input of said second inhibit circuit for timely supplying said second inhibit signal thereof;

means connected between an output of said second inhibit circuit and the control input of said first inhibit circuit for timely supplying said first inhibit signal thereto;

a viewing screen adapted for having predetermined target and background indicia projected thereon for receiving and reflecting the colored laser light shots fired thereat by the laser of said first and second simulated weapons;

means spatially disposed from said viewing screen for timely projecting said predetermined target and background indicia thereon, said projecting means having an $X_F$ signal output, a $Y_F$ signal output, and a sync signal output, with the $X_F$ signal thereof being proportional to the distance between said target and a first reference datum, with the $Y_F$ signal thereof being proportional to the distance between said target and a second reference datum that is orthogonally disposed with respect to said first reference datum, and with said sync signal occurring in predetermined synchronism with the projection of said predetermined target and background indicia; and means spatially disposed from said viewing screen and connected to the outputs of the aforesaid projecting means for receiving, distinguishing, and counting, the laser light shots reflected from said viewing screen in such manner as to provide predetermined indications of the number of hits per number of shots fired, respectively, in response to the aforesaid $X_F$, $Y_F$, and sync signals.

* * * * *